US010543976B2

(12) United States Patent
Spartis et al.

(10) Patent No.: US 10,543,976 B2
(45) Date of Patent: Jan. 28, 2020

(54) PACKAGING FOR LIGHT BULBS

(71) Applicant: Home Depot Product Authority, LLC, Atlanta, GA (US)

(72) Inventors: Elias Spartis, Atlanta, GA (US); Maelin Neipp, Atlanta, GA (US); Justin Brougham, Atlanta, GA (US)

(73) Assignee: Home Depot Product Authority, LLC, Atlanta, GA (US)

( * ) Notice: Subject to any disclaimer, the term of this patent is extended or adjusted under 35 U.S.C. 154(b) by 235 days.

(21) Appl. No.: 15/615,296

(22) Filed: Jun. 6, 2017

(65) Prior Publication Data

US 2018/0346237 A1 Dec. 6, 2018

(51) Int. Cl.

| | |
|---|---|
| ***B65D 85/42*** | (2006.01) |
| ***B65D 81/02*** | (2006.01) |
| ***B65D 59/04*** | (2006.01) |
| ***B65D 5/50*** | (2006.01) |
| ***B65D 77/04*** | (2006.01) |

(52) U.S. Cl.

CPC ..... *B65D 85/42* (2013.01); *B65D 5/5019* (2013.01); *B65D 59/04* (2013.01); *B65D 77/042* (2013.01); *B65D 81/025* (2013.01); *B65D 2577/045* (2013.01)

(58) Field of Classification Search

CPC ..... B65D 85/42; B65D 5/5019; B65D 59/04; B65D 77/042; B65D 81/025; B65D 2577/045

USPC ..... 206/418–421, 503–504, 155, 158; 299/125.125; 229/125.125

See application file for complete search history.

(56) References Cited

U.S. PATENT DOCUMENTS 724,384 A * 3/1903 Ferres ..... B65D 85/42 206/422
1,449,961 A * 3/1923 Wallace ..... B65D 5/5038 206/419

(Continued)

FOREIGN PATENT DOCUMENTS

GB 189326 A 11/1922
GB 731479 6/1955
WO WO-9745338 A1 * 12/1997 ..... B65D 71/16

OTHER PUBLICATIONS

ISA/US, International Search Report and Written Opinion issued on PCT/US18/35896, dated Aug. 30, 2018, 9 pages.

(Continued)

*Primary Examiner* — Chun Hoi Cheung
(74) *Attorney, Agent, or Firm* — Greenberg Traurig, LLP

(57) ABSTRACT

A protective sleeve, adapted to receive at least a first light bulb, includes parallel first and second panels, wherein at least the second panel includes a plurality of apertures. The package also includes a pair of sidewalls generally perpendicular to and connecting the panels, wherein the first panel, second panel and sidewalls together define an interior space. A second sleeve is adapted to receive at least a second light bulb. When the sleeve and the second sleeve are received together into the outer shell in an inverted orientation relative to each other sleeve, the respective second panels of the sleeve are adjacent each other, and the bulb portion of each of first and second light bulbs positioned with the sleeve intrudes into an interior space of the adjacent sleeve through at least one of the plurality of apertures of each of the sleeves.

20 Claims, 7 Drawing Sheets

(56) References Cited

U.S. PATENT DOCUMENTS 1,888,855 A * 11/1932 Fuller ..... B65D 5/5007 206/419
2,097,757 A * 11/1937 Deike ..... B65D 5/5059 206/422
D142,129 S 4/1945 Shepard
D142,119 S 8/1945 Parsons et al.
2,443,810 A * 6/1948 White ..... B65D 5/5069 206/422
2,562,655 A * 7/1951 Belanger ..... B65D 59/04 206/418
2,593,689 A 4/1952 Mitchell
2,667,267 A * 1/1954 Amatel ..... B65D 5/38 206/422
2,690,254 A * 9/1954 White ..... B65D 5/5016 206/422
2,883,047 A 4/1959 Candell
2,892,581 A * 6/1959 Amatel ..... B65D 5/48014 206/422
2,905,316 A * 9/1959 Forrer ..... B65D 5/5016 206/422
2,927,687 A 3/1960 Sanford
3,011,628 A 12/1961 Sprague
3,051,369 A * 8/1962 Drake ..... B65D 5/5014 206/422
3,053,431 A * 9/1962 Jacobs ..... B65D 5/38 206/422
3,069,008 A * 12/1962 Dugre ..... B65D 5/48014 206/422
D197,147 S 12/1963 Shapiro
3,134,486 A * 5/1964 Voorhies ..... B65D 5/5007 206/418
3,145,836 A * 8/1964 Tyrseck ..... B65D 5/48014 206/422
3,255,879 A * 6/1966 Paige ..... B65D 5/5007 206/422
3,349,897 A 10/1967 Stone
3,407,921 A 10/1968 Cilluffo
3,584,778 A 6/1971 Hopkins
D223,732 S 5/1972 Misenko
3,664,571 A 5/1972 Lesar
3,806,022 A * 4/1974 Gustafsson ..... B65D 5/48014 206/422
3,820,707 A 6/1974 Fischer et al.
3,822,785 A 7/1974 Getz et al.
3,941,304 A 3/1976 Barbieri et al.
4,007,836 A * 2/1977 Getz ..... B65D 5/4804 206/422
4,185,766 A 1/1980 Davidson et al.
4,231,510 A * 11/1980 Beard ..... B65D 5/5016 206/422
4,903,892 A * 2/1990 McNair ..... B65D 5/48014 206/420
4,921,099 A 5/1990 Trauschke
5,169,000 A * 12/1992 Kovacs ..... B65D 5/4802 206/422
D349,851 S 8/1994 Olsson
D351,555 S 10/1994 Blott
D351,787 S 10/1994 Hansen
D355,847 S 2/1995 Woolaway
5,597,070 A 1/1997 Wu
5,692,611 A 12/1997 Harrison
D394,385 S 5/1998 Laughlin
D427,524 S 7/2000 Weisz
D495,953 S 9/2004 Miller
D524,151 S 7/2006 Meehan
D526,894 S 8/2006 Hamuro et al.
D529,795 S 10/2006 Kragtwijk
D546,673 S 7/2007 Mongeon et al.
D552,988 S 10/2007 Kisch
D576,487 S 9/2008 Ballard
D584,605 S 1/2009 Hedlund et al.
D643,741 S 8/2011 Kaneko
D653,962 S 2/2012 Vazquez
D744,332 S 12/2015 D'Anglade
2006/0283741 A1 12/2006 Bin
2016/0362220 A1* 12/2016 Kearns ..... B65D 5/4204

OTHER PUBLICATIONS

Design of cardboard packaging registered with the EUIPO and published on Nov. 18, 2015, and assigned design No. 002845354-0003, owned by Krings Obstbau Vertriebs GmbH & Co. KG.

Design of carton registered with the EUIPO and published on Jun. 6, 2012, and assigned design No. 002049361-0001, owned by Agricola El Bosque S. L.

Design of packaging registered with the EUIPO and published on Jun. 18, 2013, and assigned design No. 002164889-0001, owned by Firma Adam's.

Design of cardboard boxes registered with the EUIPO and published on Dec. 13, 2005, and assigned design No. 000424262-0001, owned by Sonaco.

Design of Openwork packaging for light bulbs and lamps registered with WIPO and published on Sep. 30, 1998, and assigned design No. D044716-001, owned by Koninklijke Philips Electronics N.V.

* cited by examiner

PACKAGING FOR LIGHT BULBS

BACKGROUND

Fragile objects are protected by a wide array of packaging types from the light, inexpensive options made of paper to heavy, protective shipping containers. Light bulbs are no different, and packaging for these household products has come in a wide variety of forms.

Today, many current packaging solutions pack the light bulbs in an upright or nested configuration. Many require form fitting packages or other designs that are difficult to load. Other simpler packages do not have any features to sufficiently secure the bulb leading to higher than acceptable failure rates.

These conventional packaging solutions are often bulky and inefficient, leading to wasted space within the packaging. Inefficient packaging leads to increased costs in several ways. Larger packages usually use more materials for the walls, supports and dividers. Even more importantly, larger packages are more expensive to ship because fewer bulbs can be included in the same shipping container.

SUMMARY

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

An example protective light bulb sleeve is adapted to receive a first light bulb and a second light bulb in an inverted orientation relative to each other. The sleeve is also adapted to be received into an outer shell together with a second identical sleeve containing a third and a fourth light bulb. Each of the light bulbs comprises a base portion and a bulb portion. The sleeve comprises a first panel; a second panel and a pair of sidewalls. The second panel is parallel to the first panel and includes a plurality of apertures. The sidewalls are generally perpendicular to and connect the first panel and the second panel. Together, the first panel, second panel and sidewalls define an interior space. When the sleeve and the second sleeve are received together into the outer shell in an inverted orientation relative to each other package, the respective second panels of the sleeves are adjacent each other. In this configuration, the bulb portion of each of the first and second light bulbs intrudes into an interior space of the other sleeves through at least one of the plurality of apertures of each of the sleeves.

Another example protective light bulb package comprises a first sleeve, adapted to receive a first light bulb, a second sleeve adapted to receive a second light bulb, and an outer shell. Each sleeve comprises a first panel; a second panel and a pair of sidewalls. The second panel is parallel to the first panel and includes a plurality of apertures. The sidewalls are generally perpendicular to and connect the first panel and the second panel. Together, the first panel, second panel and sidewalls define an interior space. An outer shell is adapted to receive the first sleeve and the second sleeve. When the first sleeve and the second sleeve are received together into the outer shell in an inverted orientation relative to each other sleeve, the respective second panels of the sleeves are adjacent each other. In this configuration, the bulb portion of the first light bulb intrudes into an interior space of the second sleeve through at least one of the plurality of apertures of each of the first and second sleeves and the bulb portion of the second light bulb intrudes into an interior space of the first sleeve through at least one of the plurality of apertures of each of the first and second sleeves.

Still another example protective light bulb package comprises a folded, paperboard first sleeve, an identical second sleeve, and an outer rectangular sleeve. The first sleeve is adapted to receive at least a first and a second light bulb in inverted orientations relative to each other. The second sleeve is adapted to receive at least a third and a fourth light bulb in inverted orientations relative to each other. Each sleeve comprises a first panel; a second panel, a pair of sidewalls and at least one dividing partition. The outer, rectangular sleeve is adapted to receive the first sleeve and the second sleeve.

In each sleeve, the second panel is generally parallel to the first panel and both panels include a plurality of apertures. The sidewalls are generally perpendicular to and connect the first panel and the second panel. Together, the first panel, second panel and sidewalls define an interior space of each sleeve. The dividing partition connected to the first panel and the second panel, positioned between the pair of sidewalls, thereby separating the interior space into at least two compartments.

These apertures on each of the panels include a first type of apertures having an associated flap positioned on at least a portion of an edge thereof. These apertures also include a second type of apertures, the second type of apertures being smaller than the first type of apertures, further comprising a plurality of radial flaps formed from a plurality of slits extending radially into the second panel. The apertures are arranged such that at least one of the first type of apertures is vertically proximate at least one of the second type of apertures and horizontally proximate another of the second type of apertures.

When the first sleeve and the second sleeve are received together into the outer shell in an inverted orientation relative to each other sleeve, the respective second panels of each sleeve are adjacent each other. In this configuration, the bulb portion of each of the first and second light bulbs intrudes into an interior space of the second sleeve through at least one of first type of apertures of the first sleeve and at least one of the second type of apertures of the second sleeve; and the bulb portion of each of the third and fourth light bulbs intrudes into the interior space of the first sleeve through at least one of second type of apertures of the first sleeve and at least one of the first type of apertures of the second sleeve.

BRIEF DESCRIPTION OF THE DRAWINGS

The accompanying drawings, which are incorporated in and form a part of this specification, illustrate embodiments of the invention and, together with the description, serve to explain the principles of embodiments of the invention.

DETAILED DESCRIPTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the claims. Furthermore, in the detailed description of the present invention, numerous specific details are set forth in order to provide a thorough understanding of the present invention. However, it will be obvious to one of ordinary skill in the art that the present invention may be practiced without these specific details. In other instances, well known methods, procedures, and components have not been described in detail as not to unnecessarily obscure aspects of the present invention.

Generally speaking, various embodiments provide for a folded sleeve that protects fragile products, like the LED light bulbs discussed below, while efficiently packing them for transport. Such sleeves may include a variety of support and retaining features to retain the light bulb within the sleeve and prevent any unnecessary movement in transport. Such sleeves may also be adapted to be combined with an identical adjacent sleeve and an outer shell to form a package. The support and relief features cooperatively interact with complementary features on the adjacent sleeves to secure the light bulbs while also maximizing the use of internal space and minimizing outer packaging.

Figure 1:
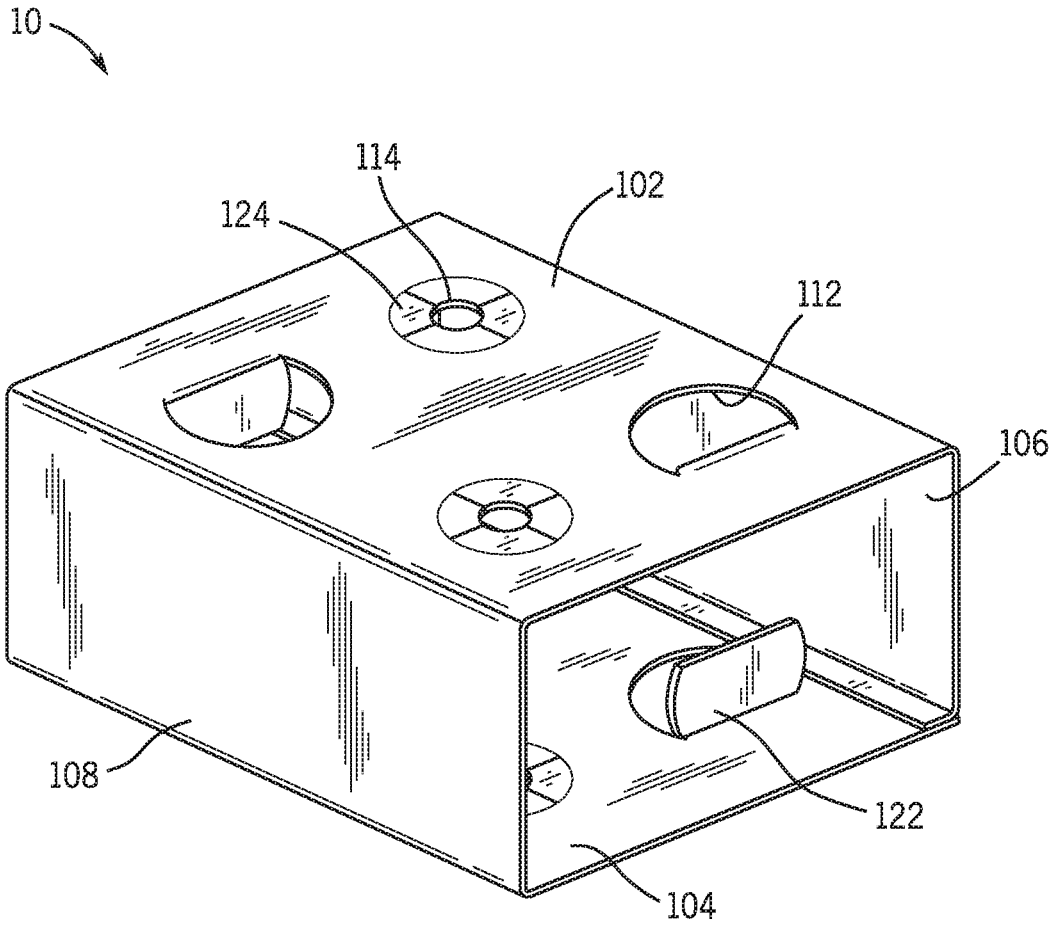
FIG. 1 is a perspective view of an example sleeve for packaging light bulbs, in accordance with various embodiments of the present invention.

Turning now to the figures, FIG. 1 shows sleeve 10 in folded form intended for use in, or as, a protective, space efficient package for light bulbs, in accordance with various embodiments of the present invention. Sleeve 10 includes first panel 102, second panel 104, and sidewalls 106 and 108. Sleeve 10 may also be constructed with a variety of features already pre-cut into the foundational material of sleeve 10, such as one or more apertures 112 and 114.

As shown in the illustrated embodiment of the sleeve 10 in a folded configuration, first and second panels 102 and 104 may be positioned generally parallel to one another. Sidewalls 106 and 108 may be generally parallel to each other and generally perpendicular to and connect first and second panels 102, 104. Collectively, first and second panels 102, 104 and sidewalls 106, 108 may define an interior space of sleeve 10. In the illustrated example, these panels or walls may be constructed from paperboard. One of ordinary skill would appreciate that other material, like corrugated cardboard, plastic, or any other suitable material, may be used instead.

One or more of the first panel, second panel, or sidewalls may include a plurality of alternating apertures and relief features, such as those shown in FIG. 1. This may include first type of aperture 112 and second type of aperture 114, which may be smaller than first type of aperture 112. Apertures in the example embodiment alternate such that each of first type of apertures 112 is vertically proximate to at least one of second type of apertures 114 and horizontally proximate another of second type of apertures 114 as shown. It should be appreciated that in embodiments utilizing a single-bulb sleeve, the sleeve need only have at least one first type of aperture 112 and at least one second type of aperture 114.

First type of aperture 112 may be sized and shaped to permit at least a portion of a light bulb to pass therethrough, thereby permitting a part of the light bulb to extend outside of the interior space of sleeve 10. First type of aperture 112 may cooperate with another first type of aperture 112 located at a complementary position, e.g., on an opposing panel, so as to secure a bulb in place. Further, because first type of aperture 112 and second type of aperture 114 may be inverted relative to another adjacent pair of first type of aperture 112 and second type of aperture 114, multiple light bulbs may be retained in an inverted orientation relative to each other, as shown and described in more detail below.

Various embodiments may also contain one or more additional relief features separate from, or as part of, either type of aperture. For instance, first type of aperture 112 may include flap 122 positioned on at least a portion of an edge thereof, as shown in the example embodiment. Flap 122 may be formed from a slit cut out of the sleeve material, which in turn may form first type of aperture 112. In another example, the relief features may be a plurality of radial flaps 124 that generally surround the second type of aperture 114. Radial flaps 124 may be formed by a plurality of slits through the sleeve extending radially from the aperture into the second panel. In this example, the slits into the sleeve material occur roughly every ninety degrees around second type of aperture 114 and thereby form quarter arc-shaped flaps. The function of these relief features is explained further below.

Figure 2:
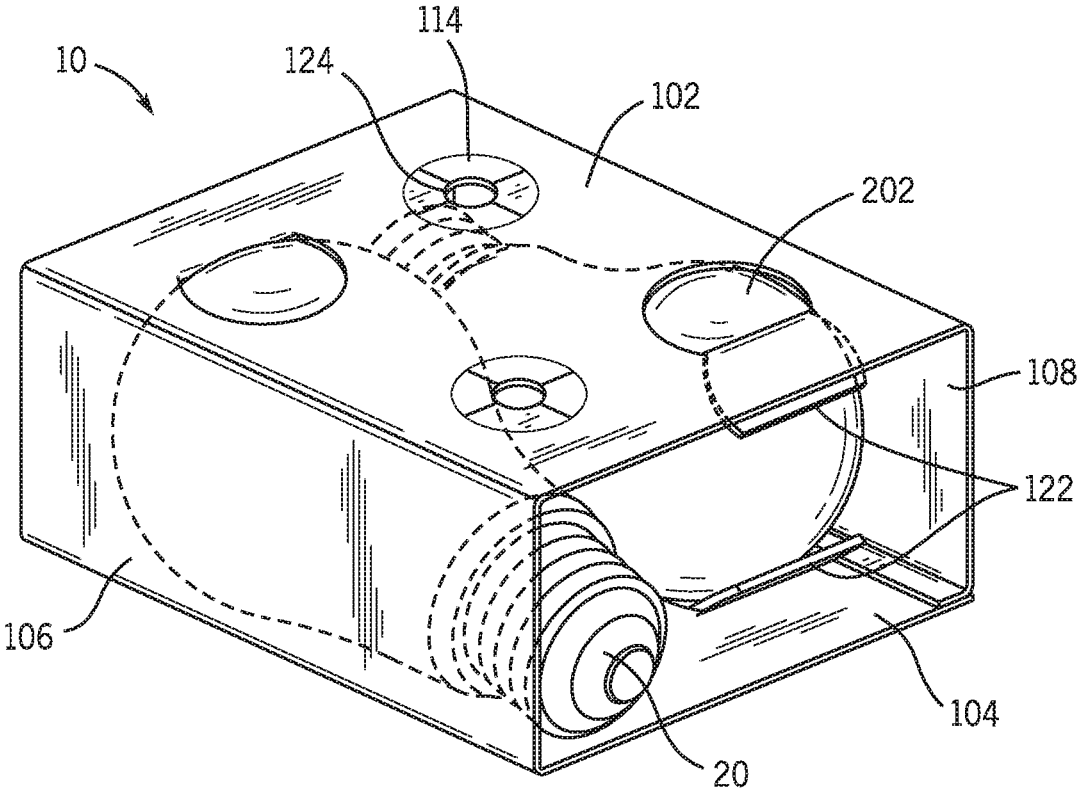
FIG. 2 is a perspective view of the single folded sleeve of FIG. 1, shown loaded with two bulbs.

FIG. 2 illustrates sleeve 10 of FIG. 1 loaded with two example light bulbs 20. As shown, sleeve 10 serves as a protective package for two light bulbs 20. In sleeves designed to retain multiple bulbs 20, bulbs 20 may be placed into sleeve 10 in bilateral or inverse orientations, such as shown in FIG. 2. It should be appreciated that embodiments are not limited to two-bulb sleeves and that sleeves accommodating other numbers of bulbs, including a single bulb, are contemplated herein. It should be further appreciated that while embodiments may be shown and described as accommodating a standard "A" bulb, embodiments are not limited as such, and the present disclosure contemplates sleeves capable of accommodating various other shapes of light bulbs.

As also shown in FIG. 2, some relief features are used to secure and restrain a light bulb in place within sleeve 10. Flap 122 may be adapted to support an upper portion of bulb portion 202 and prevent bulb 20 from sliding out of an open end of sleeve 10. Flap 122 is shown in the extended position functioning as both a stop and cradle for bulb 20.

Figure 3:
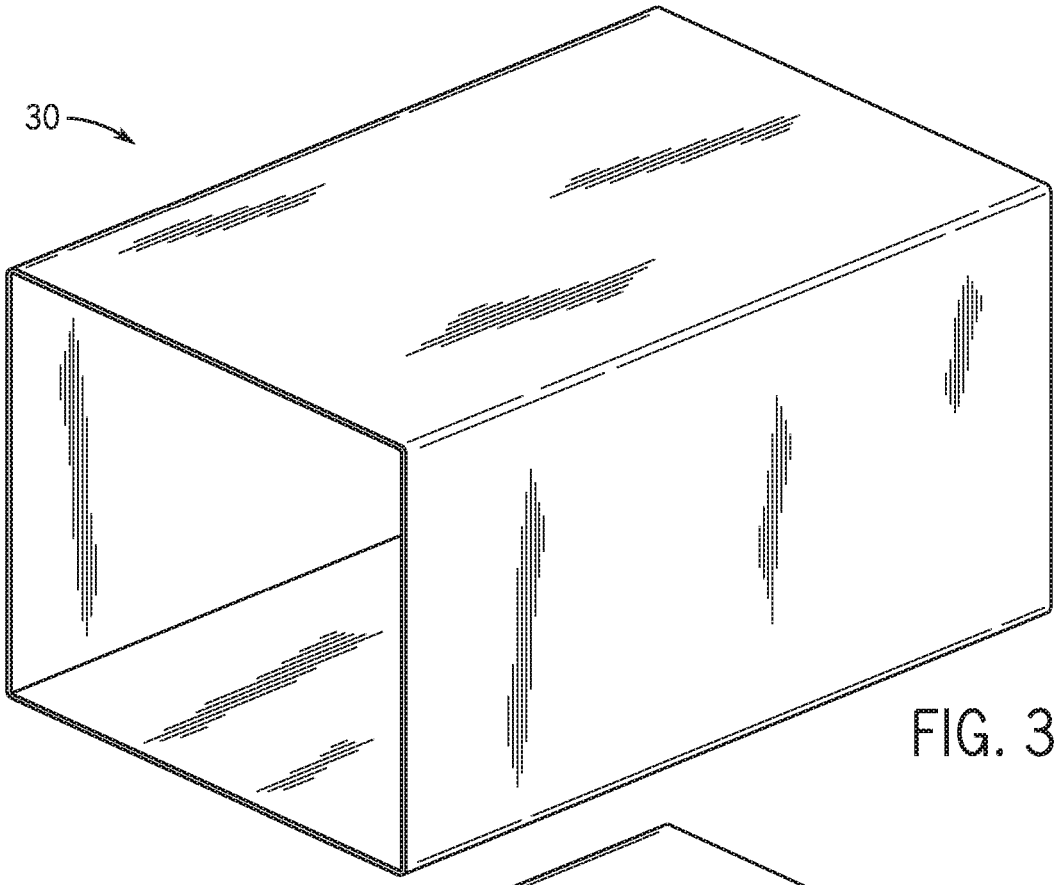
FIG. 3 is a perspective view of an example outer shell, in accordance with various embodiments of the present invention.

As noted above, sleeve 10 according to various embodiments may cooperate with another identical sleeve 10' when positioned together in outer shell 30. FIG. 3 illustrates an example of outer shell 30, which in the illustrated embodiment is an outer sleeve. Outer shell 30 could also be a six-sided box or any other container suitable for tightly securing multiple sleeves 10, 10'.

Figure 4:
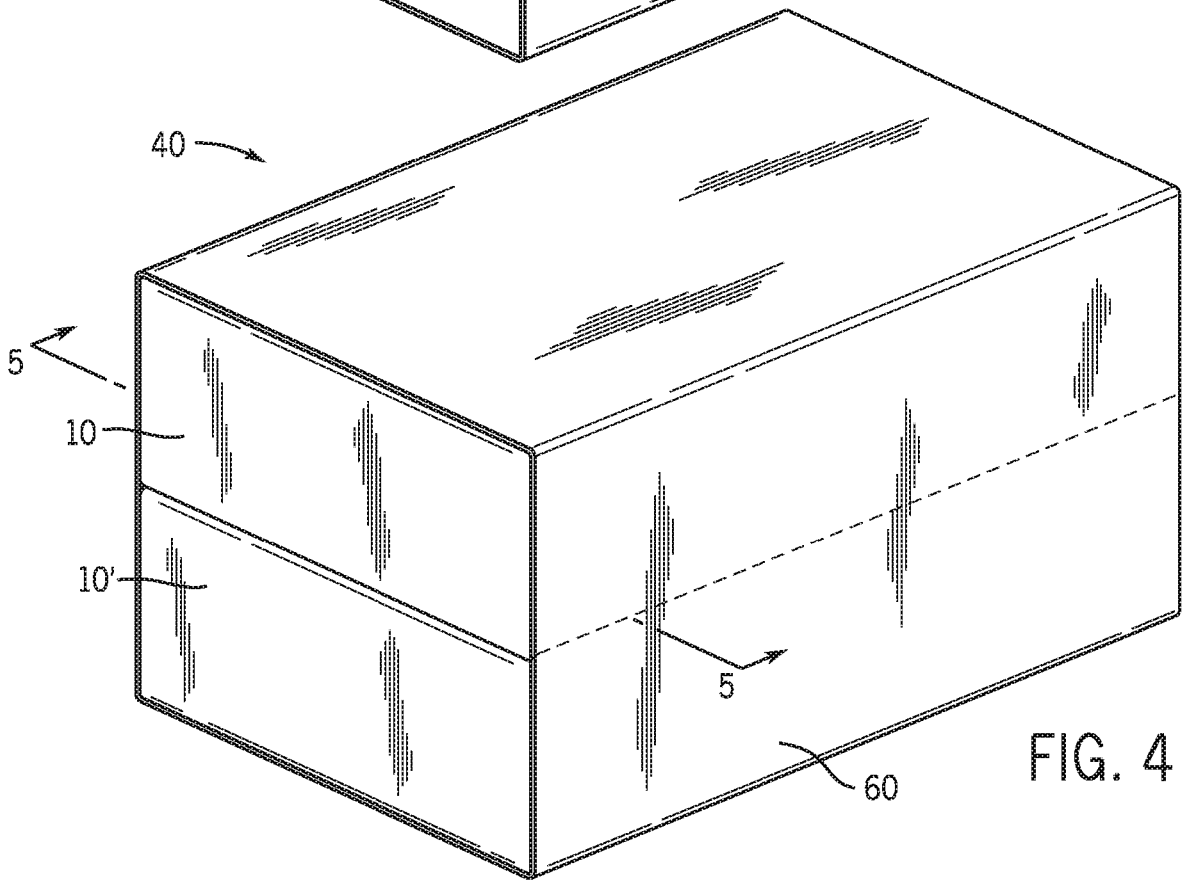
FIG. 4 is a perspective view of two light bulb sleeves cooperatively inserted in an outer shell, in accordance with various embodiments of the present invention.

FIG. 4 shows two light bulb sleeves 10, 10' cooperatively inserted into outer shell 30 to form a package 40, in accordance with various embodiments of the present invention. As shown, outer shell 30 fits snugly around sleeves 10, 10'. More specifically, outer shell 30 may be under-dimensioned relative to sleeves 10, 10' such that sleeves 10, 10' are slightly compressed. This aids in minimizing the total volume of package 40. Sleeve 10 is placed in an inverted orientation relative to sleeve 10'. This inverted configuration places the respective second panels 102 of sleeves 10, 10' adjacent each other.

Figure 5:
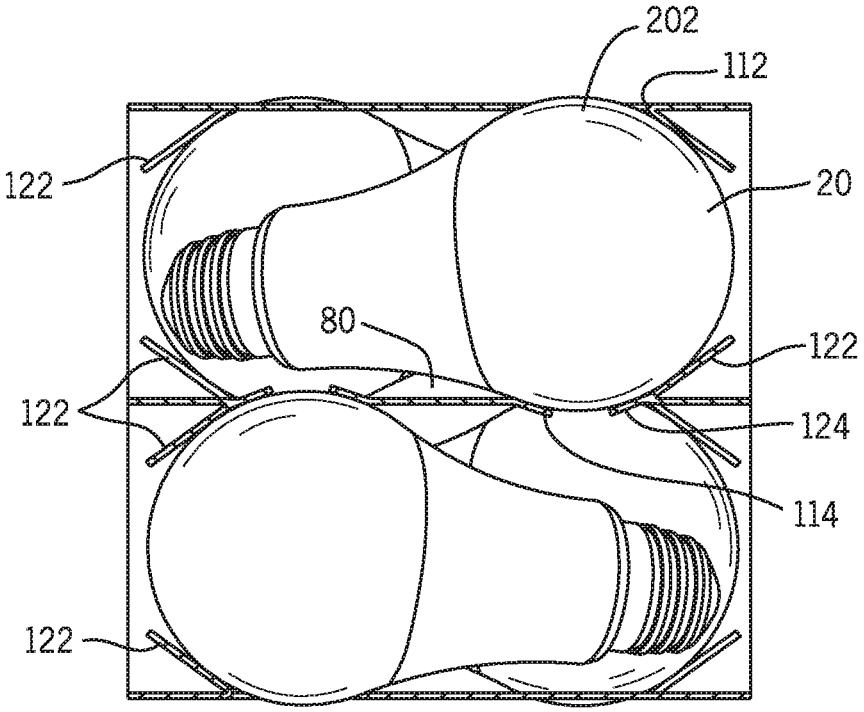
FIG. 5 is a cross-sectional view taken across lines 8-8 in FIG. 7.

FIG. 5 shows a cross-sectional view of package 40, in accordance with various embodiment of the present invention. As shown, when sleeves 10, 10' are placed into outer sleeve 30 as shown in FIG. 4, first type of apertures 112 of sleeve 10 are aligned with second type of apertures 114 of sleeve 10', and vice versa. This arrangement allows bulb portion 202 of each light bulb 20 in each sleeve to extend through a first type of aperture 112 and at least partially intrude into the interior space of the other sleeve through a corresponding and complementary second type of aperture 114.

In this configuration, the relief features may include one or more relief features that give or flex in order to permit bulb 20 from sleeve 10 to invade the interior space of adjacent sleeve 10' and vice versa. In some embodiments, those relief features may include a plurality of radial flaps 124 that generally surround the second type of aperture 114. Flaps 124, by flexing inward, allow bulb portion 202 of bulb 20 to be positioned within the adjacent sleeve to enter into the interior space of the subject sleeve.

Thus, in the illustrated example of FIG. 5, bulb portion 202 of light bulb 20 extends out of first type of aperture 112 of sleeve 10 and is pressed through second type of aperture 114 of sleeve 10' so as to at least partially intrude the interior space of sleeve 10', and vice versa. Radial flaps 124 flex inward, as shown in the cross sectional view of FIG. 5, to allow the bulb portion into the interior space of sleeve 10'. Depending on which of the panels and sidewalls have apertures, the sleeves may be arranged to efficiently stack in more than one direction. For example, if sidewalls 106 and 108 similarly include first and second types of apertures, further space-spacing may be achieved through positioning sleeves end to end.

Figure 6:
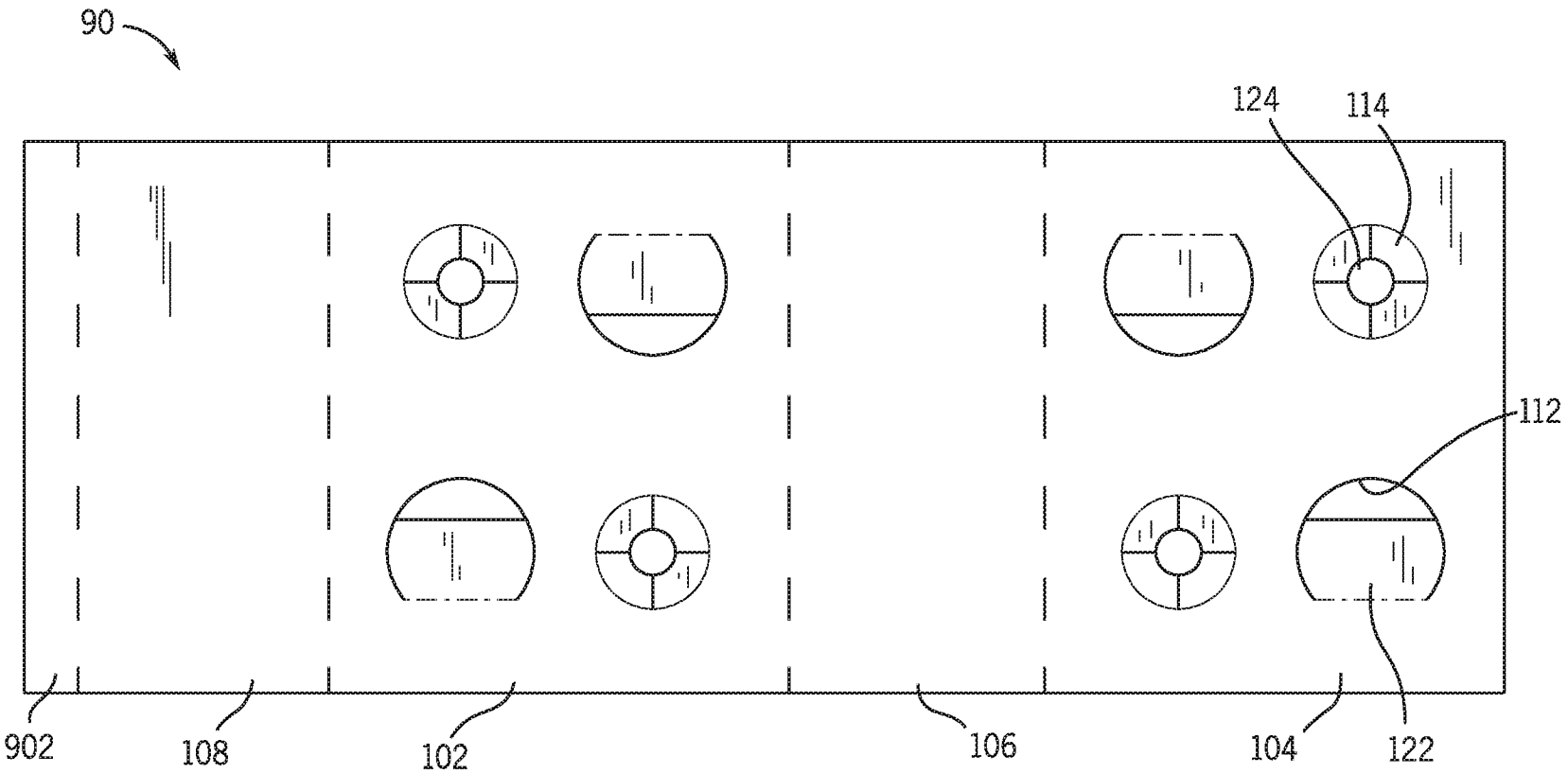
FIG. 6 is a plan view of an example light bulb sleeve unfolded, in accordance with various embodiments of the present invention.

FIG. 6 shows unfolded sleeve 90. Folded sleeve 10 may be constructed by folding a piece of flat paperboard to form first panel 102, second panel 104 generally parallel to it, and connecting sidewalls 106 and 108. The sleeve may be folded along pre-cut, perforated fold lines to form a substantially rectangular cuboid. The fold lines could also be created by other weakened lines in the paperboard or other conventional techniques as would be appreciated by one of ordinary skill in the art.

In the illustrated embodiment, first panel 102 and second panel 104 may be positioned generally parallel to each other when folded. A connecting portion of unfolded sleeve 90, located between first and second panels 102, 104 becomes first sidewall 106 approximately perpendicular to first and second panels 102, 104. Second sidewall 108 may be created by adhering end portion 902 extending from sidewall 108 to the second panel 104. End portion 902 may also be affixed by other means including a hook and slot or other equivalent methods.

Figure 7:
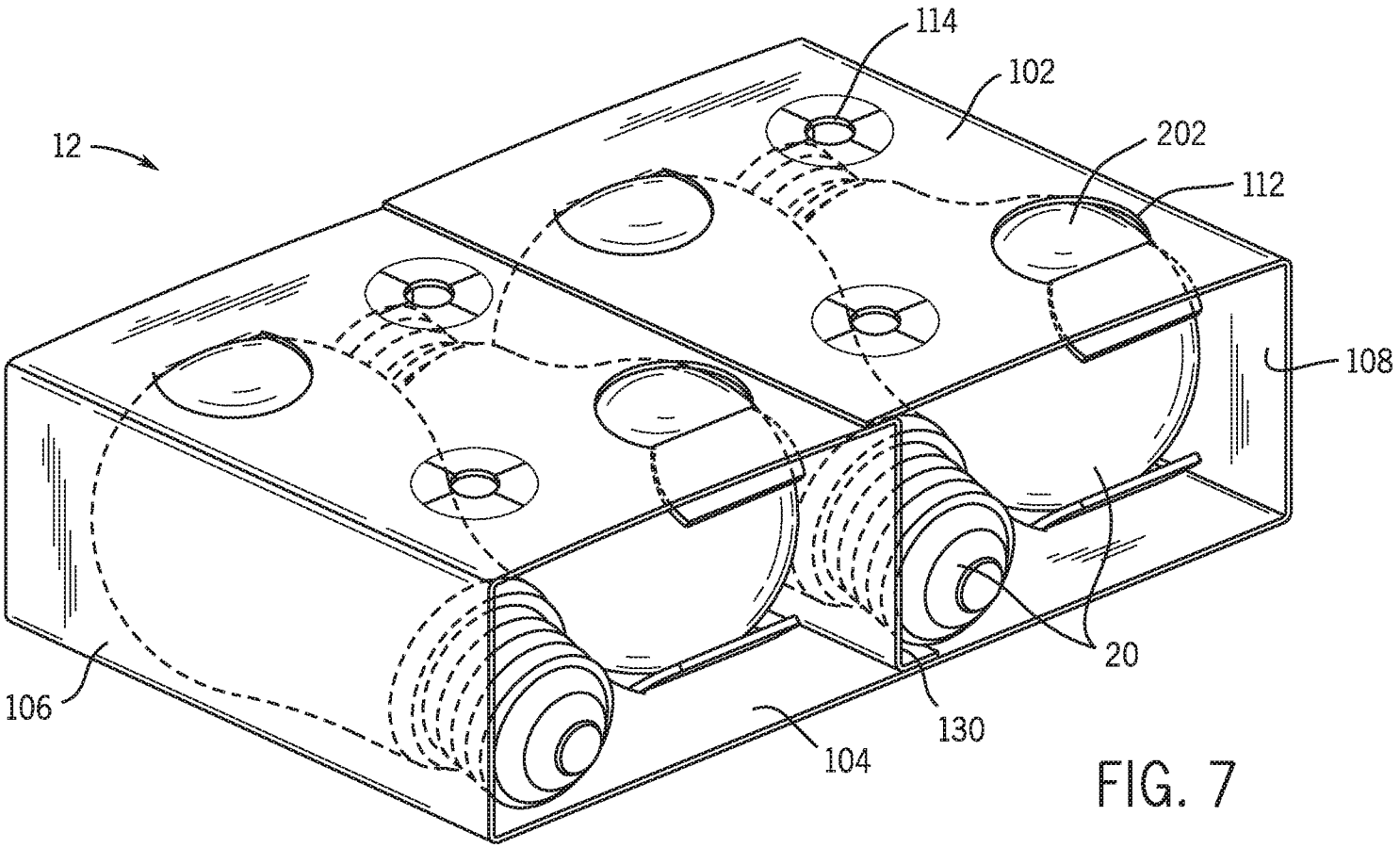
FIG. 7 is a perspective view of an example sleeve for packaging light bulbs, shown loaded with four bulbs, in accordance with various embodiments of the present invention.

FIG. 7 illustrates dual-chambered folded sleeve 12, in accordance with various other example embodiments. This example holds four light bulbs 20 in an alternating arrangement. As shown, dual-chambered sleeve 12 includes generally parallel first and second panels 102, 104 connected by sidewalls 106, 108. Like single-chambered sleeve 10 described above, the panels 102, 104 of sleeve 12 have a plurality of first and second types of alternating apertures 112, 114 designed to hold and secure a light bulb.

Figure 8:
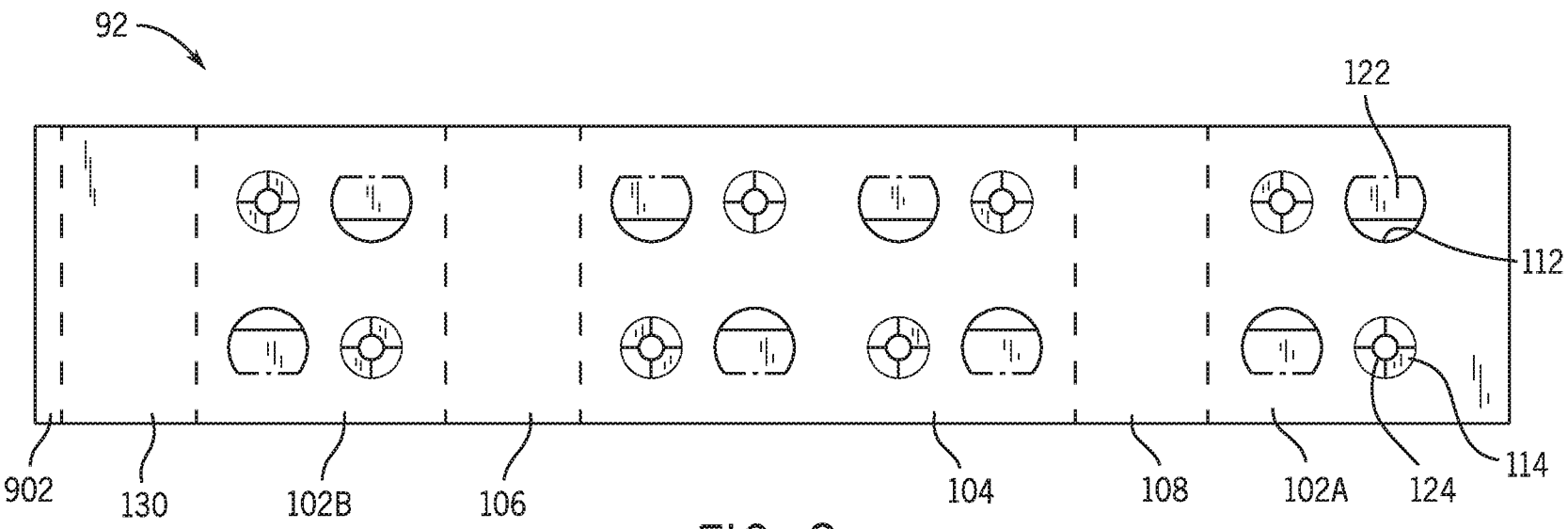
FIG. 8 is a plan view of the example light bulb sleeve of FIG. 7 unfolded, in accordance with various embodiments of the present invention.

Dual-chambered sleeve 12 may additionally include at least one dividing partition 130. Dividing partition 130 extends between first panels 102 and second panel 104 and may be positioned roughly at their midpoints, thereby dividing the interior space of sleeve 12 into at least two chambers. Each chamber may hold, for example, two light bulbs 20 in a nested, bilateral configuration. In the example shown in FIG. 7, only one dividing partition 130 is shown separating the sleeve. One of ordinary skill in the art would appreciate that multiple dividing partitions could be used FIG. 8 shows unfolded dual chambered sheet 92, which may be folded into dual chambered sleeve 12 of FIG. 7. Like unfolded single chambered sleeve 90 shown in FIG. 6, dual chambered sleeve 12 is constructed by folding the panels to form first panel 102, second panel 104, and sidewalls 106, 108. In the example shown, first panel 102 is formed by the combination of first section 102A and second section 102B, which are connected to each other at the approximate center of dual chambered sleeve 12. In this configuration, dividing partition 130 extends in the interior of dual chambered sleeve 12 with end portion 902 connected to second panel 104.

Thus, packaging designs according to various embodiments create a solution that significantly reduces the amount of packing materials and overall package volume for light bulbs. Specifically, various embodiments enable the use of materials lighter than corrugated cardboard and other more expensive materials to optimize material usage and cost. For example, the eight-bulb design using dual-chambered sleeve 12 shown in FIGS. 7 and 8, reduces the shipping footprint of the package by 18% over current methods and reduces material usage by 15%. Conventional packages could fit five facings in 49.75 $in^3$ compared to six facings in 45.75 $in^3$ for the disclosed design. This reduced footprint results in reduced shipping cost, which in turn results in an overall lower cost to the consumer.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. A first protective light bulb sleeve comprising:

a first panel;

a second panel parallel to the first panel, wherein the second panel includes a plurality of apertures; and a pair of sidewalls generally perpendicular to and connecting the first panel and the second panel, wherein the first panel, second panel and sidewalls together define an interior space, wherein, a light bulb is placed within the first protective bulb and the first protective light bulb sleeve is received together with a second protective light bulb sleeve identical to the first protective light bulb sleeve into an outer shell in an inverted orientation relative to each other such that the respective second panels of the sleeves are adjacent to each other, a bulb portion of the light bulb intrudes into an interior space of the second sleeve through at least one of the plurality of apertures the first protective light bulb sleeve.

2. The first protective light bulb sleeve of claim 1 further comprising at least one dividing partition connected to the first panel and the second panel, positioned between the pair of sidewalls separating the interior space into at least two compartments.

3. The first protective light bulb sleeve of claim 1 further comprising a relief feature.

4. The first protective light bulb sleeve of claim 3 wherein the relief feature comprises a flap.

5. The first protective light bulb sleeve of claim 1 wherein the first panel includes a plurality of apertures.

6. The first protective light bulb sleeve of claim 1 wherein the apertures comprise a first type of apertures and a second type of apertures, the apertures being arranged such that at least one of the first type of apertures is vertically proximate at least one of the second type of apertures and horizontally proximate another of the second type of apertures.

7. The first protective light bulb sleeve of claim 6 wherein the first type of apertures is larger than the second type of apertures and each of the first type of apertures has an associated flap positioned on at least a portion of an edge thereof.

8. The first protective light bulb sleeve of claim 6 wherein each of the second type of apertures comprises a plurality of radial flaps formed from a plurality of slits extending radially into the second panel.

9. The first protective light bulb sleeve of claim 8 wherein, the first protective light bulb sleeve and the second protective light bulb sleeve are received together into the outer shell, the bulb portion of the light bulb intrudes into the interior space of the first sleeve through at least one of the first type of apertures of the second sleeve and at least one of the second type of apertures of the first sleeve.

10. The first protective light bulb sleeve of claim 9, wherein the light bulb is a first light bulb, and wherein the first protective light bulb sleeve and the second protective light bulb sleeve are received together into the outer shell, a bulb portion of a second light bulb inserted into the first protective light bulb sleeve intrudes into the interior space of the second protective light bulb sleeve through at least one of second type of apertures of the second sleeve and at least one of the first type of apertures of the first sleeve.

11. The first protective light bulb sleeve of claim 10 wherein the radial flaps of the second type of apertures flex into the interior space of the second protective light bulb sleeve in order to permit the bulb portion of the second light bulb to invade the interior space of the second sleeve; and the radial flaps of the second type of apertures flex into the interior space of the first sleeve in order to permit the bulb portion of the first light bulb to invade the interior space of the first sleeve.

12. The first protective light bulb sleeve of claim 1 wherein the package comprises folded paper board.

13. The first protective light bulb sleeve of claim 1 wherein the outer shell comprises a rectangular sleeve.

14. The first protective light bulb sleeve of claim 1 wherein the outer shell comprises a six sided folding carton.

15. A protective light bulb package comprising:

a first sleeve comprising:

a first panel;

a second panel parallel to the first panel, wherein the second panel includes a plurality of first apertures; and a pair of first sidewalls generally perpendicular to and connecting the first panel and the second panel, the first panel, second panel and first sidewalls together defining a first interior space;

a second sleeve comprising:

a third panel;

a fourth panel parallel to the third panel, wherein the fourth panel includes a plurality of apertures; and a pair of second sidewalls generally perpendicular to and connecting the third panel and the fourth panel, the third panel, fourth panel and second sidewalls together defining a second interior space; and an outer shell configured to receive the first and second sleeves, wherein the first apertures are sized and shaped such that a first light bulb is placed within the first sleeve, a bulb portion of the first light bulb extends from the interior space of the first sleeve to the interior space of the second sleeve, and wherein the second apertures are sized and shaped such that a second light bulb is placed within the second sleeve, a bulb portion of the second light bulb extends from the interior space of the second sleeve to the interior space of the first sleeve.

16. The protective light bulb package of claim 15 further comprising a relief feature.

17. The protective light bulb package of claim 16 wherein the relief feature comprises a flap.

18. The protective light bulb package of claim 15 wherein the plurality of first and second apertures comprise a first type of apertures and a second type of apertures, the apertures being arranged such that at least one of the first type of apertures is vertically proximate at least one of the second type of apertures and horizontally proximate another of the second type of apertures.

19. The protective light bulb package of claim 15 wherein the outer shell comprises a rectangular sleeve.

20. A protective light bulb package comprising:

a first light bulb with a first bulb portion;

a second light bulb with a second bulb portion;

a third light bulb with a third bulb portion;

a fourth light bulb with a fourth bulb portion;

a first paperboard sleeve adapted to receive at least the first light bulb and the second light bulb in an inverted orientation relative to each other and a second paperboard sleeve adapted to receive at least the third light bulb and the fourth light bulb in an inverted orientation relative to each other, each of the first and second sleeves comprising:

a first panel;

a second panel generally parallel to the first panel, wherein the first and second panels each include a plurality of apertures, the apertures comprising:

a first type of apertures having an associated flap positioned on at least a portion of an edge thereof; and a second type of apertures, the second type of apertures being smaller than the first type of apertures and further comprising a plurality of radial flaps formed from a plurality of slits extending radially into the second panel, wherein the apertures are arranged on each of the first and second panels such that at least one of the first type of apertures is vertically proximate at least one of the second type of apertures and horizontally proximate another of the second type of apertures;

a pair of sidewalls generally perpendicular to and connecting the first panel and the second panel, the first panel, second panel and sidewalls together defining an interior space; and a dividing partition connected between the first panel and the second panel and positioned between the pair of sidewalls, thereby separating the interior space into at least two compartments;

an outer, rectangular sleeve adapted to receive the sleeve and the identical sleeve;

wherein, the first and second sleeves are received together into the outer shell in an inverted orientation relative to each other, the first and second bulb portions intrude into the interior space of the second sleeve through at least one of first type of apertures of the first sleeve and at least one of the second type of apertures of the second sleeve; and the third and fourth bulb portions intrude into the interior space of the first sleeve through at least one of first type of apertures of the second sleeve and at least one of the second type of apertures of the first sleeve.

* * * * *